US009060547B2

(12) United States Patent
Kurz et al.

(10) Patent No.: US 9,060,547 B2
(45) Date of Patent: Jun. 23, 2015

(54) DEVICE FOR SMOKING CESSATION AND USE OF SUCH A DEVICE

(76) Inventors: Matthäus Kurz, Kufstein (AT); Thomas Kurz, Kufstein (AT)

( * ) Notice: Subject to any disclaimer, the term of this patent is extended or adjusted under 35 U.S.C. 154(b) by 187 days.

(21) Appl. No.: 13/578,549

(22) PCT Filed: Feb. 8, 2011

(86) PCT No.: PCT/EP2011/051817
§ 371 (c)(1),
(2), (4) Date: Aug. 29, 2012

(87) PCT Pub. No.: WO2011/098446
PCT Pub. Date: Aug. 18, 2011

(65) Prior Publication Data

US 2012/0318284 A1 Dec. 20, 2012

(30) Foreign Application Priority Data

Feb. 10, 2010 (EP) ..... 10153163

(51) Int. Cl.
*A24F 47/00* (2006.01)
*A24F 13/22* (2006.01)

(52) U.S. Cl.
CPC ..... *A24F 13/22* (2013.01)

(58) Field of Classification Search
CPC ..... A24D 3/00; A24D 3/045; A24D 3/18; A24F 7/00; A24F 7/02; A24F 7/04; A24F 13/00; A24F 13/02; A24F 13/04; A24F 13/06; A24F 13/22; A24F 47/00
USPC ..... 131/270, 272; 285/334.2, 382.4, 382.5, 285/397; 29/522.1, 523
See application file for complete search history.

(56) References Cited

U.S. PATENT DOCUMENTS 1,699,956 A * 1/1929 Darrow et al. ..... 131/257
1,862,679 A 6/1932 Holsman
1,959,717 A 5/1934 Hill (Continued)

FOREIGN PATENT DOCUMENTS

AT 386109 B 7/1988
DE 29811610 U1 12/1998

(Continued)

OTHER PUBLICATIONS

International Preliminary Report on Patentability for PCT/EP2011/051817 mailed Aug. 14, 2012.

(Continued)

*Primary Examiner* — Richard Crispino
*Assistant Examiner* — Eric Yaary
(74) *Attorney, Agent, or Firm* — Harness, Dickey & Pierce, PLC

(57) ABSTRACT

The invention relates to a device for smoking cessation, consisting of a cylindrical sleeve (2), the inside diameter $d_I$ of which is dimensioned such that the sleeve can be placed positively and completely on a cigarette (1) so that the cigarette (1) projects beyond both free ends (22) of the sleeve (2), and the sleeve jacket (3) has a thickness $S_Q$ of at least 1 mm. The invention further relates to a use of such a device as a cigarette holder.

14 Claims, 2 Drawing Sheets

(56) References Cited

U.S. PATENT DOCUMENTS

| | | | | |
|---|---|---|---|---|
| 4,873,999 | A | 10/1989 | Steinert | |
| 2001/0052699 | A1* | 12/2001 | Guest | 285/323 |
| 2010/0117356 | A1* | 5/2010 | Pucciani | 285/238 |

FOREIGN PATENT DOCUMENTS

| | | | |
|---|---|---|---|
| DE | 202005005506 | U1 | 8/2005 |
| DE | 102005016415 | A1 | 11/2006 |
| DE | 202007004678 | U1 | 8/2007 |
| FR | 2605192 | A3 | 4/1988 |
| GB | 286481 | A | 3/1928 |
| GB | 365376 | A | 1/1932 |
| GB | 367570 | A | 2/1932 |

OTHER PUBLICATIONS

International Search Report (in English and German) for PCT/EP2011/051817, mailed Apr. 19, 2011; ISA/EP.

* cited by examiner

DEVICE FOR SMOKING CESSATION AND USE OF SUCH A DEVICE

CROSS-REFERENCE TO RELATED APPLICATIONS

This application is a 371 U.S. National Stage of International Application No. PCT/EP2011/051817, filed Feb. 8, 2011, and published in German as WO/2011/098446 Al published on Aug. 18, 2011. This application claims priority to European Patent Application 10153163.0, filed Feb. 10, 2010. The entire disclosures of the above applications are incorporated herein by reference.

The present invention relates to a device for quitting smoking consisting of a cylindrical sleeve, the inner diameter of which is dimensioned such that it can be slipped positively onto a cigarette.

Furthermore, the present invention relates to the use of such a device as a cigarette holder.

In the course of the bans on smoking, which have become very far-reaching in the meantime, in particular in public buildings, in workplaces, in aircraft, in railways, in restaurants and hostelries etc, there is a high demand for aids to quitting smoking, that is to say means which make it easier for a smoker to give up cigarettes. A further reason is the knowledge that smoking contains risks that are highly dangerous to the health of the smoker, and the health of the environment and in particular of non-smokers is highly endangered by passive smoking.

To this extent, several proposals have already been made which, firstly, eliminate the damaging effects of the cigarette smoke without restricting the action of nicotine, see in particular DE 10 2005 016 415 A1, or else are intended to make complete withdrawal from the consumption of cigarettes easier.

In principle, the systems known from the prior art are based on the idea of, whilst avoiding a withdrawal of nicotine, weaning the smoker so far off cigarettes that after some time complete quitting of smoking is possible.

For example, DE 20 2007 004 678 U1 proposes a smoke-free cigarette which has a deposit filter with a defined dimensional hole and a mouthpiece filter with a defined-shape hole to accommodate the deposit filter, a nano-bead solution being provided in the deposit filter, on which nano-beads nicotine and possibly flavourings are deposited.

Another, similar device is disclosed by DE 20 2005 005 506. Here a cigarette inhaler is described for the inhalation of volatile active substances, a cylindrical body having a continuous axial hole being inserted so as to fit into a cigarette sleeve having a filter arranged on one side, and a material storing the active inhalation substance being arranged within the hole. The inhaler here corresponds to the form of a cigarette and permits the smoke-free inhalation of the active nicotine substances.

A further quitting device is disclosed by U.S. Pat. No. 386,109 B, here a cigarette tip for a cigarette being described which comprises an input sleeve to hold the cigarette and a mouthpiece. In the wall of the cigarette tip, in the area of the mouthpiece, at least one passage opening is provided, the axis of which is inclined with respect to the longitudinal axis of the tip and the mouthpiece. According to the invention, as a result of the configuration of the cigarette tip for quitting smoking, smoke is intended to stream from the opening of the tip towards the nose of the user, which will be found to be unpleasant by the latter.

As has become apparent, the use of the above products is not very successful when quitting smoking. The reason for this is firstly that the smoker always has the feeling of dispensing with a cigarette, since the use of the replacement materials and replacement products described above does not give him the accustomed "satisfaction" during the quitting time. Secondly, the products are normally very expensive, which reinforces the feeling of the smoker of making a sacrifice and thus keeps him attached to cigarettes.

Furthermore, the prior art, for example U.S. Pat. No. 4,873,999 A, FR 2 605 192 A3, GB 365 376 A or U.S. Pat. No. 1,959,717 A, discloses cigarette holders which keep the unpleasant smell of smoke away from the fingers of a smoker. As a result, however, the opposite of quitting smoking is achieved.

The object of the present invention is consequently to offer a device for quitting smoking which permits simpler and lasting quitting of smoking products and in particular of cigarettes.

The above object is achieved in an extremely simple way by means of a device for quitting smoking according to Patent Claim 1.

In particular, this object is therefore achieved by a device for quitting smoking consisting of a cylindrical sleeve, the inner diameter of which is dimensioned such that it can be positively and completely slipped onto a cigarette, so that the cigarette protrudes from both free ends of the sleeve, and the sleeve jacket of which has a thickness $s_Q$ of at least 1 mm. In principle, within the context of the present invention, the sleeve in combination with the cigarette can also be viewed as a device for quitting smoking.

An important point of the device according to the invention for quitting smoking is therefore a sleeve which can be completely pushed onto the cigarette or slipped over the cigarette in such a way that the latter protrudes beyond both free ends of the sleeve and which, during smoking, remains on the cigarette as a cigarette holder. During use, the sleeve according to the invention is pushed onto the cigarette in such a way that the filter or a similar mouthpiece of the cigarette projects out of the sleeve on one side, so that the smoker can take it into his mouth, the sleeve being held between the fingers by the smoker during smoking; the sleeve therefore serves, inter alia, as a cigarette holder.

On account of the formation of the sleeve in the manner described previously, during the action of drawing on the cigarette, on account of the air sweeping along the inside of the sleeve, condensation is formed on the inside of the sleeve and on the cigarette, which changes the development of smoke from the cigarette and, in particular, reduces the inhaled quantity of nicotine. Although the smoker continues to smoke a cigarette as accustomed, the consumption of nicotine is reduced and, in addition, the smoker is made aware of his cigarette consumption by the use of the device. The result is gradual quitting of smoking.

The outer shell of the sleeve preferably exhibits a milled symmetrical section having a smaller diameter than the diameter of the outer shell, an annular groove milled into the milled symmetrical section then preferably being provided on the axis of symmetry of the sleeve.

Within the scope of the present invention, the term milled is understood to mean any machining of the sleeve forming the respective milled sections and annular grooves. Here, milling also means, amongst other things, sawing in, piercing, removing material, cutting off material, folding, pressing, deep-drawing, laser machining, rolling, erosion, etc.

In the above embodiment, particularly effective formation of condensation occurs on account of the changed cross sections of the sleeve over the length of the cigarette.

Particularly advantageous here is the production of the sleeve from a metal material, it being possible here for the sleeve in particular to be milled out by means of appropriate metal-processing methods. On account of the ratio of the different heat transfer coefficients of the materials which are operatively connected with one another when the sleeve is pushed onto the cigarette, the action of the device according to the invention is intensified. It is also possible to produce the sleeve from a multilayer material, of which at least one layer is produced from a metal material. For example, a plurality of sub-sleeves having different diameters can be pushed onto one another with an accurate fit and then together form the sleeve according to the invention. A sleeve can be produced from a metal material and a preferably smaller sleeve of a plastic material adjacent thereto.

At least three insert elements made from a material differing from the material of the sleeve, and in particular insert elements made of at least one neodymium magnet, are inserted preferably in even distribution over the circumference of the annular groove. Here, a particularly advantageous effect of the device according to the invention has become apparent.

The insert element is preferably inserted into a two-stage bored hole in the sleeve, which extends radially in the annular groove used from the outer shell towards the interior of the sleeve, the first, outer stage of the bored hole having a larger radius than the inner, second stage. In this connection, it is particularly preferable if the second, inner stage extends as far as the interior of the sleeve.

The sleeve preferably has at least one longitudinal bored hole in its sleeve jacket, which extends parallel to the main axis of extension. This longitudinal bored hole can extend partly or even completely from one free end to the other free end of the sleeve. In particular, it is preferred to form the sleeve with at least three such longitudinal bored holes in its sleeve shell which, distributed evenly over the circumference, extend parallel to the main axis of extension of the sleeve. Given three such longitudinal bored holes, the result is therefore a distribution offset by 120° each over the circumference of the sleeve, i.e. an offset angle of 120°.

The sleeve preferably has an inner diameter of between 6 mm and 9 mm, in particular 7.97 mm. This inner diameter has proven to be particularly advantageous and effective when conventional cigarettes are used. When used with thinner cigarettes, what are known as "slim-line" cigarettes, on the other hand, an inner diameter of 4 mm to 7 mm, in particular 5.4 mm, is advantageous.

The ratio of the overall length of the sleeve to the length of the milled symmetrical section is preferably substantially 3:10, in particular the overall length of the sleeve is 20 mm and the length of the milled symmetrical section is 6 mm. In principle, the length of the sleeve is preferably less than one third of the length of the cigarette with which the sleeve is used.

The jacket of the sleeve preferably has a thickness of 1.6 mm to 2.0 mm, in particular 1.8 mm, in the area of the milled symmetrical section. In the case of the cigarettes known from the prior art, a sleeve jacket with these dimensions has proven to be particularly advantageous.

Preferably, the outer diameter of the milled symmetrical section is 0.1 mm to 0.3 mm, in particular 0.2 mm, smaller than the outer diameter of the outer shell, and the base diameter of the annular groove is 0.1 mm to 0.3 mm, in particular 0.2 mm, smaller than the outer diameter of the milled symmetrical section.

Preferably, a substantially radially outwardly facing ring collar is provided on at least one free end of the sleeve. This ring collar is preferably 1 mm to 3 mm, in particular 2 mm, larger than the outer diameter of the outer jacket. In the case of a preferred outer diameter between 9.21 mm and 11.21 mm, in particular 10.21 mm, the outer diameter of the ring collar is consequently between 11.21 mm and 13.21 mm, in particular 12.21 mm.

As regards the geometry of the ring collar, a semicircular geometry, in particular with a radius of 1 mm, has proven to be particularly advantageous.

Further embodiments of the invention can be gathered from the sub-claims.

In the following text, the invention will be described by using exemplary embodiments, which are explained in more detail by the appended drawings, in which:

In the following text, the same reference numbers are used for identical and identically acting components, from time to time apostrophes being used for the purpose of distinction.

FIG. 1 shows an isometric illustration of a first embodiment of the device according to the invention for quitting smoking.

Figures 1, 2, 3, 4:
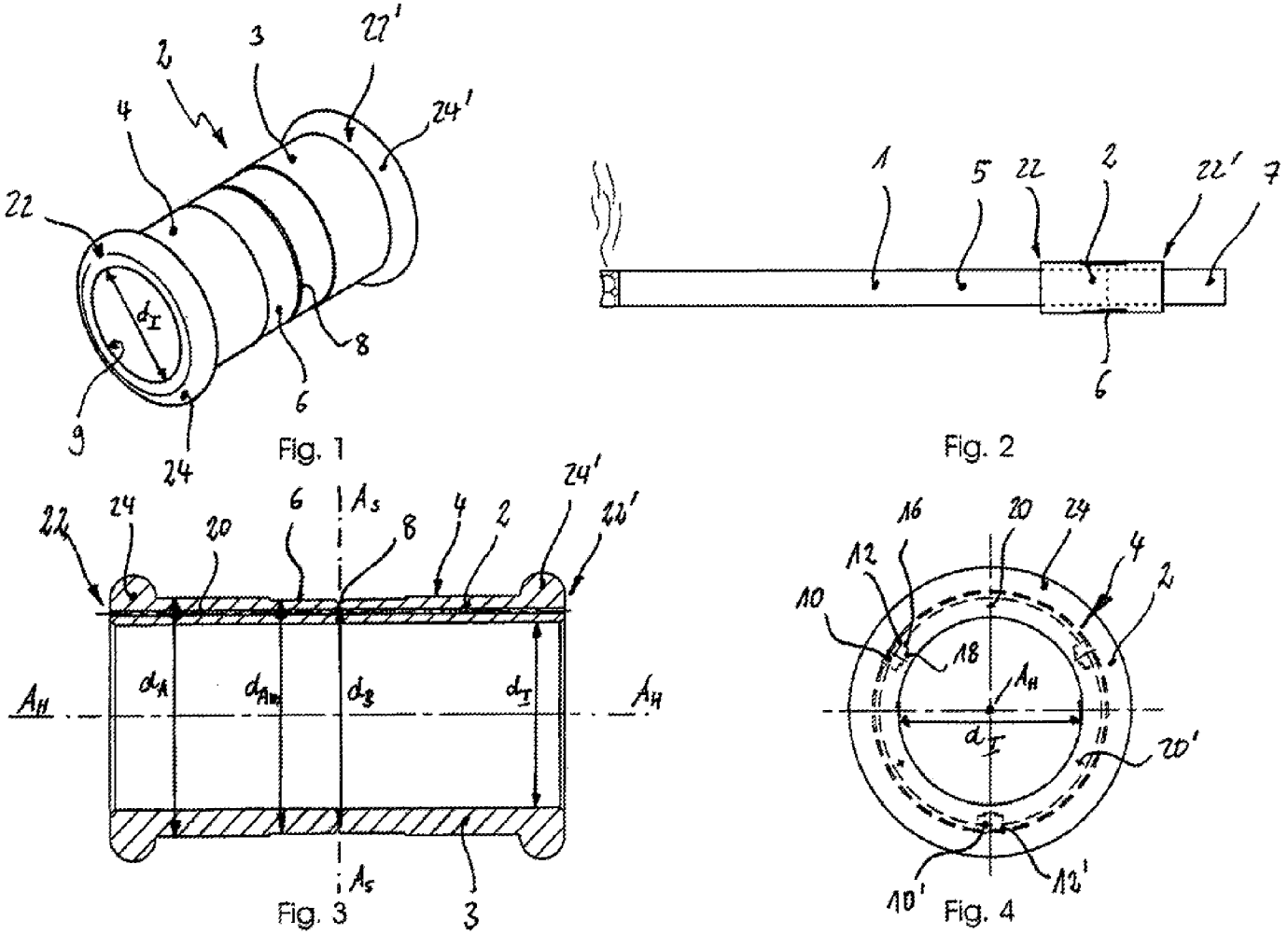
FIG. 1 shows a first embodiment of the device according to the invention for quitting smoking in an isometric illustration.
FIG. 2 shows a schematic illustration of the embodiment according to FIG. 1 when pushed onto a cigarette.
FIG. 3 shows a longitudinal section through the embodiment according to FIG. 1.
FIG. 4 shows a cross section through the embodiment according to FIG. 1.

The device consists of a cylindrical sleeve 2, the inner diameter $d_i$ of which is dimensioned such that it can be positively and completely slipped onto a cigarette 1 (see FIG. 2) such that the cigarette 1 protrudes from both free ends 22 of the sleeve 2, and the sleeve jacket 3 of which has a thickness $s_Q$ of at least 1 mm.

Here, the outer shell 4 of the sleeve 2 additionally centrally has a milled symmetrical section 6 having a smaller diameter than the diameter of the outer shell 4. The precise diameter values will be discussed in more detail below. In the central section and in particular on the axis of symmetry $A_S$ (see in particular FIGS. 3 and 4) of the sleeve 2, a milled annular groove 8 is additionally provided in the milled symmetrical section 6, running completely around the sleeve 2. At its free ends 22, the sleeve 2 in this embodiment additionally has a ring collar 24, which extends radially outwards from the shell 4.

In FIG. 2, the first embodiment of the device according to the invention illustrated in FIG. 1 is shown when slipped onto a cigarette 1. The sleeve 2 is formed in such a way that it can be pushed positively and completely onto the cigarette, specifically such that a part and, in particular here, the part 5 to be burnt protrudes from one free end 22, and the filter part 7 or the part via which the smoker draws on the cigarette 1 protrudes at the other free end 22'. The smoker (not shown) grips the cylindrical sleeve 2, in particular in the area of the symmetrical section 6. Once the cigarette 1 has almost been smoked completely, the said smoker can push back the device according to the invention towards the filter 7 as desired and, shortly before, after or as it is pushed off the cigarette, can remove and reuse the said device.

As a result of the formation according to the invention of the device for quitting smoking, in particular of the cylindrical sleeve 2, condensation is formed on the inner shell 9 of the sleeve 2 and thus directly on the cigarette 1 during smoking, which condensation impairs the ability of the cigarette 1 to be smoked and, in particular, reduces the ability to inhale nicotine. In particular as a result of the described change in cross section between the outer shell 4, the central symmetrical section 6 milled therein and the annular groove 8, there is an action on the cigarette 1 which will gradually lead to quitting smoking. Since, moreover, during the use of the device according to the invention, the smoker is made more aware of each smoking operation, quitting smoking and complete withdrawal from smoking is made considerably easier.

In FIGS. 3 and 4, the embodiment according to FIGS. 1 and 2 is shown in a longitudinal section (FIG. 3) and a cross section (FIG. 4). As shown there, the device according to the invention comprises the sleeve 2, the inner diameter $d_I$ of which permits it to be pushed onto the cigarette 1 (see FIG. 2).

The sleeve 2 comprises the outer shell 4, into which the symmetrical section 6 is milled or similarly incorporated centrally and symmetrically with respect to the axis of symmetry $A_S$. The annular groove 8, which runs annularly around the sleeve 2, is introduced on the axis of symmetry $A_S$ or in the plane of symmetry formed by these axes running radially around. The outer diameter $d_A$ of the shell 4 is slightly larger than the outer diameter $d_{Am}$ of the symmetrical section 6 and the base diameter $d_B$ of the annular groove 8. Here, base diameter $d_B$ is understood to mean the diameter formed by the bottom surface of the annular groove 8. According to the invention, the annular groove 8 is formed here as an indentation and in particular as a 45° triangular indentation in the symmetrical section 6.

At the free ends 22 of the sleeve 2, radially outwardly facing annular collars 24 are provided which, in this embodiment, have an essentially semicircular geometry.

As can be seen in particular in FIG. 4, bored holes 12 distributed evenly over the circumference of the sleeve 2 are provided in the symmetrical section 6, extending from the outside of the sleeve to the interior 14. Inserted into these three bored holes 12 are insert elements 10, the material of which differs from the material of the sleeve 2. In particular, the insert elements 10 here are formed as neodymium magnets. On account of the change in the material and cross section in this area, a particularly intense formation of condensation is surprisingly effected.

The bored holes 12 are implemented as two-stage bored holes, the outer, first stage 16 having a larger bored hole radius than the inner, second stage 18. The insert elements are preferably arranged only in the outer, first stage 16.

In this embodiment, longitudinal bored holes 20 preferably but not necessarily distributed evenly over the circumference are provided, extending in the shell 3 of the sleeve, parallel to the main axis of extension $A_H$, from one free end 22 to the other free end 22'. The longitudinal bored holes 20 present here are therefore formed as continuous longitudinal bored holes 20. According to the invention, they, and also the two-stage bored holes 12, are likewise distributed evenly over the circumference of the sleeve 2. The mutual radial offset angle between the longitudinal bored holes and between the two-stage bored holes is consequently 120° here. The two-stage bored holes and the longitudinal bored holes are, moreover, preferably arranged such that they each enclose an offset angle of 60°; the bored holes 12 and 20 shown in FIG. 4 are therefore each arranged distributed evenly offset by 60° over the circumference.

Figure 6:
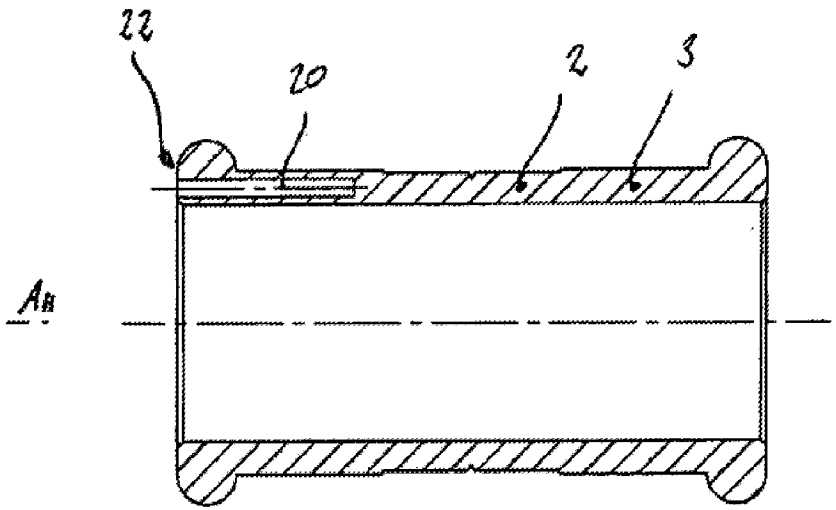
FIG. 6 shows a third embodiment of the device according to the invention in longitudinal section.
Figure 5:
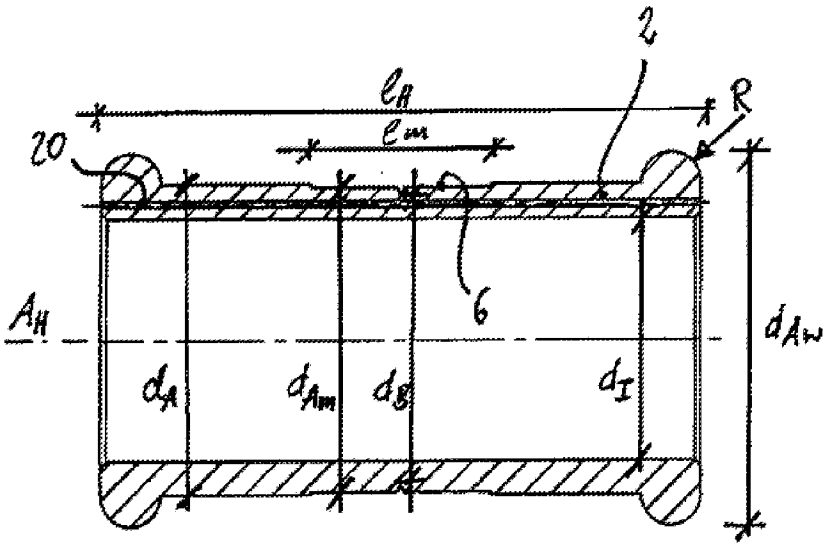
FIG. 5 shows a second embodiment of the device according to the invention in longitudinal section.

FIG. 5 shows a second embodiment of the device according to the invention for quitting smoking, which corresponds substantially to the embodiment according to FIGS. 1-4 but is characterized by specific dimensions. The sleeve 2 according to the invention, specifically and in an embodiment according to FIGS. 1-4, has the following dimensions:

Overall length $I_H$ of the sleeve 2: 20 mm;
Overall length $I_m$ of the milled symmetrical section 6: 6 mm;
Outer diameter $d_A$ of the sleeve 2: 10.21 mm;
Outer diameter $d_{Am}$ of the milled symmetrical section 6: 10.1 mm;
Base diameter $d_B$ of the annular groove 6: 9.81 mm;
Outer diameter $d_{AW}$ of the ring collar: 12.21 mm;
Radius R of the ring collar: 1 mm;
Inner diameter $d_I$ of the sleeve: 7.97 mm;
Diameter of the outer, first stage 16 of the two-stage bored hole 12: 1.1 mm;
Depth of the outer, first stage 16: 0.7 mm;
Diameter of the inner, second stage 18 of the two-stage bored hole 12: 0.6 mm;
Depth of the inner, second stage 18: 0.1 mm;
Diameter of the longitudinal bored hole 20: 0.2 mm;
Distance of the mid-axis of the longitudinal hole 20 to the main axis of extension $A_H$ of the sleeve 2: 4.47 mm;

FIG. 6 shows a third embodiment of the device according to the invention for quitting smoking, which corresponds substantially to the embodiments described previously. However, this sleeve 2 has a longitudinal bored hole 20 which extends only partly along the shell 3 of the sleeve 2 from the free end 22. In addition, the sleeve 2 has only a single longitudinal bored hole 20.

The invention claimed is:

1. A device for quitting smoking consisting of a cylindrical sleeve having a thickness of at least 1 mm, an inner diameter of the sleeve dimensioned such that the sleeve can be positively and completely slipped onto a cigarette such that the cigarette protrudes from both free ends of the sleeve, wherein;

an outer surface of the sleeve includes a milled symmetrical section having a smaller diameter than a diameter of the outer surface, wherein a milled annular groove is provided in the milled symmetrical section on the sleeve, and wherein at least three insertion elements made from a different material than the material of the sleeve are inserted into the sleeve along the annular groove.

2. The device according to claim 1, wherein the milled symmetrical section is arranged at the center of the outer surface of the sleeve, wherein the milled annular groove is provided on the axis of symmetry of the sleeve.

3. The device according to claim 1, wherein the insertion elements are inserted into the sleeve in even distribution along the circumference of the annular groove.

4. The device according to claim 3, wherein at least one insertion element is a neodymium magnet.

5. The device according to claim 3, wherein at least one insertion element is inserted into a two-stage borehole in the sleeve which extends radially in the middle annular groove from the outer surface toward the interior of the sleeve, wherein an outer first stage of the borehole exhibits a large radius than an inner second stage.

6. The device according to claim 5, wherein the inner second stage extends to the interior of the sleeve.

7. The device according to claim 1, wherein the sleeve exhibits at least one longitudinal borehole in its sleeve jacket which extends parallel to the main axis of extension of the sleeve.

8. The device according to claim 1, wherein the sleeve exhibits at least three longitudinal boreholes in its sleeve jacket which are evenly distributed along the circumference of the sleeve and extend parallel to the main axis of extension of the sleeve.

9. The device according to claim 1, wherein the sleeve exhibits an inner diameter of between 6 mm and 9 mm.

10. The device according to claim 1, wherein a ratio of the overall length of the sleeve to the length of the milled symmetrical section essentially amounts to 3:10.

11. The device according to claim 1, wherein a sleeve jacket of the sleeve exhibits a cross-sectional thickness of 1.6 mm to 2.0 mm in the area of the milled symmetrical section.

12. The device according to claim 1, wherein the outer diameter of the milled symmetrical section is 0.1 mm to 0.3 mm, smaller than the diameter of the outer surface, and the base diameter of the annular groove is 0.1 mm to 0.3 mm, smaller than the outer diameter of the milled symmetrical section.

13. The device according to claim 1, wherein the sleeve exhibits a substantially radially outward facing ring collar on at least one free end.

14. The device according to claim 1, wherein the sleeve is made of a metal material.

* * * * *